US011777227B1

(12) United States Patent
Wink et al.

(10) Patent No.: US 11,777,227 B1
(45) Date of Patent: Oct. 3, 2023

(54) RADIO FREQUENCY TRANSMISSION ASSEMBLY

(71) Applicant: Lockheed Martin Corporation, Bethesda, MD (US)

(72) Inventors: Timothy Patrick Wink, Castle Rock, CO (US); Nathan Jastram, Highlands Ranch, CO (US); Matthew David Arendall, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 28 days.

(21) Appl. No.: 17/685,508

(22) Filed: Mar. 3, 2022

(51) Int. Cl.
*H01Q 21/00* (2006.01)
*H01Q 21/06* (2006.01)

(52) U.S. Cl.
CPC ..... *H01Q 21/064* (2013.01); *H01Q 21/0025* (2013.01)

(58) Field of Classification Search
CPC .. H01Q 21/0025; H01Q 21/064; H01Q 13/02; H01Q 13/0208; H01Q 13/0241; H01Q 13/0275; H01Q 13/0283; H01Q 13/0291; H01Q 13/06; H01Q 13/065
See application file for complete search history.

(56) References Cited

U.S. PATENT DOCUMENTS

| | | | | |
|---|---|---|---|---|
| 10,665,931 | B2 * | 5/2020 | Lier | H01P 1/173 |
| 11,217,901 | B1 * | 1/2022 | Wink | H01Q 13/0283 |
| 2018/0219295 | A1 * | 8/2018 | Griesi | H01Q 13/0225 |
| 2020/0099140 | A1 * | 3/2020 | Khalil | H01L 23/66 |

* cited by examiner

*Primary Examiner* — Daniel Munoz

(57) ABSTRACT

Enhanced components and assemblies for microwave radio frequency (RF) antenna feed systems are provided. One example includes radiating probes that propagate RF signals to intermediate waveguides that feed polarizers or filters associated with horn antenna elements. The radiating probes can couple to corresponding transmit/receive circuitry using coaxial link elements. The radiating probes comprise tunable components which can be shaped/sized to produce desired output characteristics (e.g., frequency ranges and gain properties). Many radiating probes can be integrated into a cover plate assembly that feeds an array of horn antennas. Interface elements with integrated waveguides can provide RF sealing between radiating probes and provide radiative coupling from radiating probes to corresponding waveguides that feed the array of horn antennas.

20 Claims, 7 Drawing Sheets

RADIO FREQUENCY TRANSMISSION ASSEMBLY

TECHNICAL BACKGROUND

Microwave radio frequency (RF) transmission and receiving systems are employed across a wide range of application areas, including satellite communications, terrestrial telecommunications, wireless data transmission, telemetry, surveillance, remote sensing and control, among other applications. Often, RF transmit/receive circuitry is employed in concert with radiative elements, such as aperture antennas and associated feed structures and waveguides. Aperture antennas are a form of RF antenna used for directed transmission and reception of various RF signals, often employed in microwave radio transmissions or in reflector antenna feed systems. Example aperture antennas include horn antennas and short backfire antennas, among others. Horn antennas comprise a source port which feeds into a flared volume surrounded by walls that define the general horn-like shape.

When large quantities of antenna elements are desired, such as in electronically steered arrays (ESAs), designing and assembling interconnect or interposer solutions between circuitry and radiative components presents many challenges. Some solutions exist to couple RF signals for arrays across coaxial links using large-scale interconnects and interposers that require complex, expensive designs which are difficult to manufacture with associated reliability and performance concerns. For example, offboarding of RF signals from a circuit board can be achieved using coaxial connectors, planar connections, or cables. However, these approaches suffer from misalignment issues, potentially large mating forces, and high RF losses, especially when large arrays of concurrent connections are required. Another approach includes using blind mate connections which are difficult to correctly align, require verification of successful connection, and can cause damage to hardware components if not aligned properly during mating.

OVERVIEW

The examples discussed herein provide radio frequency (RF) energy transfer between transmit/receive circuitry and antenna feed components, such as between printed circuit boards (PCBs) and waveguides used to feed horn antenna elements. This energy transfer occurs over enhanced coaxial connector assemblies using radiating probe components that carry RF signals from conductive connections of a circuit board to radiative RF waveguide cavities. Also, enhanced array interfacing plates can be employed to couple many individual coaxial RF connections without a corresponding upscaling of connection insertion force from the many RF connections. Example systems which can incorporate such connector assemblies include electronically steered arrays (ESAs) or other antenna arrays fed by waveguides and transmit/receive circuitry coupled to associated PCBs. Individually-connected radiating probes can reduce stack-up tolerances, insertion and removal difficulty, and RF losses. Each radiating probe can be tuned across multiple frequency ranges by modifying one or various components of the probes, waveguides, or the assembly providing for flexible configurations. By incorporating coaxial type connectors in such assemblies, low-cost, mass-producible, and high-performance RF interfaces can be achieved.

One example implementation includes an antenna assembly comprising a cover plate for a circuit board coupled to RF coaxial stubs, the cover plate having a top side and a bottom side and comprising holes into which the RF coaxial stubs fit from the bottom side and radiating elements couple onto to the RF coaxial stubs from the top side. The antenna assembly further comprises a transition plate comprising waveguide cavities that transition between individual ones of the radiating elements on the top side of the cover plate and corresponding ports of horn antennas. Each of the radiating elements of the antenna assembly comprise a radiating probe having a generally cylindrical shape offset from a base by a filleted extension, a connector body configured to attach to an outer conductor portion of a corresponding coaxial RF stub and form the base on an end opposite from the corresponding coaxial RF stub, and a conductor element configured to conductively couple a center conductor of the corresponding coaxial RF stub to the radiating probe and electrically isolate the radiating probe from at least the base.

Another example implementation includes an apparatus comprising an RF radiating element. The RF radiating element comprises a radiating probe having a generally cylindrical shape offset from a base by a filleted extension, a connector body configured to attach to an outer conductor portion of a corresponding coaxial RF link and form the base on an end opposite from the corresponding coaxial RF link, and a conductor element configured to conductively couple a center conductor of the corresponding coaxial RF link to the radiating probe and electrically isolate the radiating probe from at least the base.

In yet another example, a method is provided. The method relates to assembling a RF radiating system, and it comprises physically coupling a coaxial bullet to a connector arrangement of a circuit board and conductively coupling a coaxial RF link of the coaxial bullet to a conductor of the circuit board. The method further comprises physically coupling a feed end of a radiating element offset from a radiating end of the radiating element by a filleted extension to the coaxial RF link of the coaxial bullet and conductively coupling the feed end to an outer conductor portion of the coaxial RF link. Then, the method comprises placing a mounting plate over the radiating element and the coaxial bullet through a cavity in the mounting plate, securing a portion of the radiating element to the coaxial bullet and the mounting plate with an adhesive, and interfacing the radiating end of the radiating element with a waveguide cavity at the mounting plate.

This Overview is provided to introduce a selection of concepts in a simplified form that are further described below in the Detailed Description. It may be understood that this Overview is not intended to identify key features or essential features of the claimed subject matter, nor is it intended to be used to limit the scope of the claimed subject matter.

BRIEF DESCRIPTION OF THE DRAWINGS

Many aspects of the disclosure can be better understood with reference to the following drawings. While several implementations are described in connection with these drawings, the disclosure is not limited to the implementations disclosed herein. On the contrary, the intent is to cover all alternatives, modifications, and equivalents.

DETAILED DESCRIPTION

Discussed herein are enhanced components and assemblies related to radio frequency (RF) transmission between circuit boards and waveguides that feed antenna elements. One example includes radiating probe elements that propagate RF signals to waveguides that feed antenna elements, such as horn antenna elements. These radiating probe elements are coupled to corresponding RF circuitry using coaxial link elements that can include short coaxial stubs or coaxial "bullet" adapters along with coaxial connectors which are mounted to a circuit board. The radiating probe elements comprise tunable components which can be shaped and/or sized to produce desired output characteristics, such as desired frequency ranges, gain properties, or loss characteristics. When large arrays of antenna elements are employed, such as in ESAs or other arrays, many such radiating probe elements can be employed. Interface plates or mounting plates can provide mechanical mounting and RF sealing between circuit boards, interconnect, and corresponding waveguides/antennas Enhanced mating features are also presented herein which provide for many RF connections of an array made individually instead of concurrently, reducing insertion/mating forces and misalignment among connectors.

Figure 1:
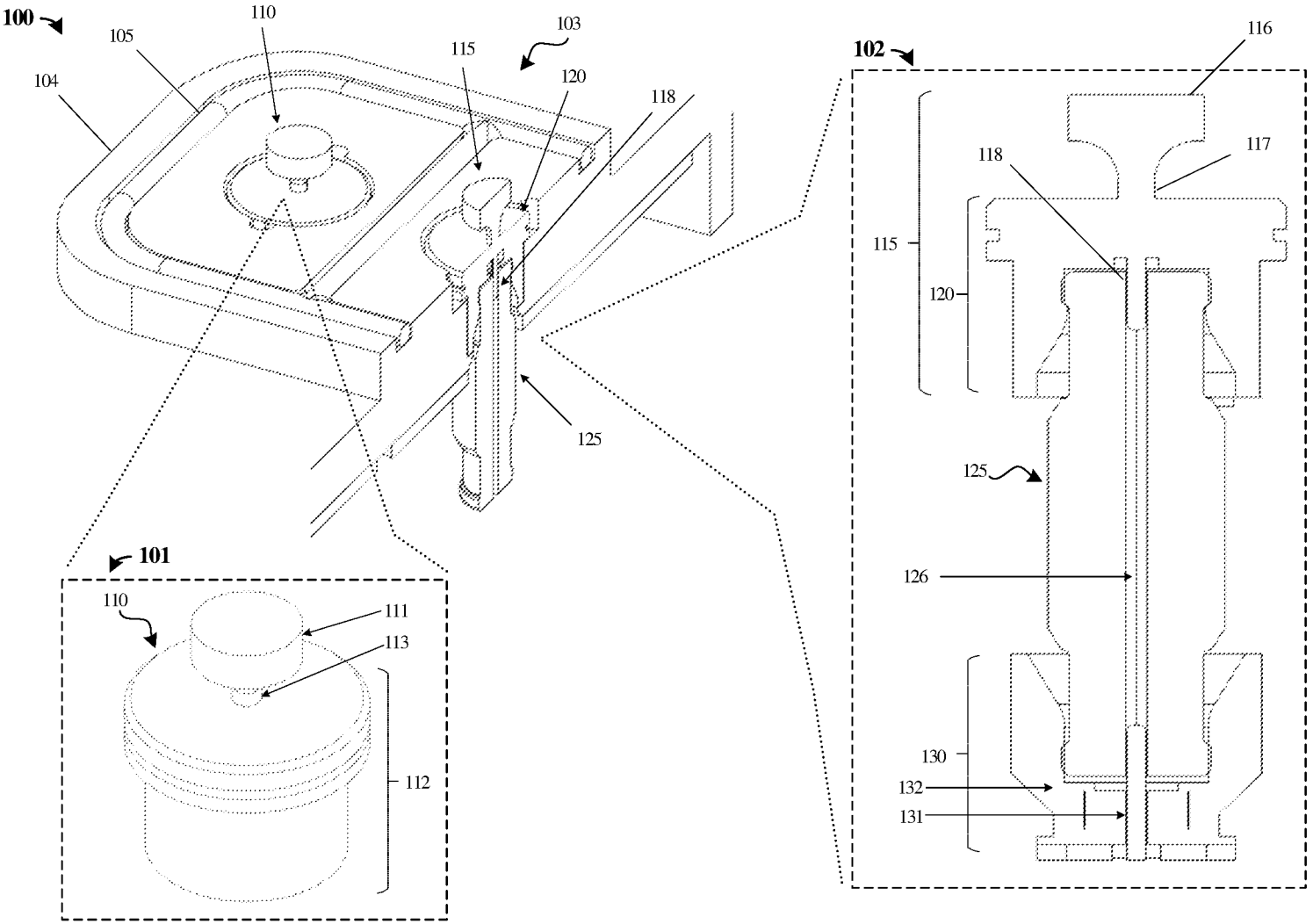
FIG. 1 illustrates example aspects of a cover plate and accompanying radio frequency radiating element used in an implementation.

Turning now to the Figures, FIG. 1 includes views 100, 101, and 102 that illustrate various features of an enhanced antenna assembly. View 100 illustrates cover plate 103, interface platform 104, RF seal 105, radiating element 110, and radiating element 115. View 101 illustrates radiating element 110 and associated components including radiating probe 111 and connector body 112. View 102 illustrates a detailed view of radiating element 115 which includes radiating probe 116, filleted extension 117, conductor element 118, and connector body 120. View 102 also illustrates RF coaxial stub 125 and circuit board connector 130.

In view 100, a portion of a cover plate having an array of interface structures forming interface platforms is shown. One such structure, interface platform 104, is included on cover plate 103 comprising two holes or apertures into which radiating elements can be inserted. Cover plate 103 can comprise several of these interface platforms which are shown as elevated or embossed on a top side of cover plate 103. Each interface platform 104 can hold one or more radiating elements, such as two radiating elements 110 and 115 in this example. To affix each radiating element into interface platform 104, the radiating elements can be pressed, twisted, screwed, or otherwise inserted into place into a corresponding cavity of interface platform 104. In an inserted position, a portion of radiating elements 110 and 115, namely radiating probes 111 and 116, can protrude from interface platform 104 and extend above both interface platform 104 and cover plate 103. Meanwhile, other portions of radiating elements 110 and 115, such as connector bodies 112 and 120, may remain flush or recessed into a hole of interface platform 104. It may be appreciated that to further secure a radiating element to interface platform 104 of cover plate 103, such as radiating element 110 or 115, an adhesive can be applied or injected into the respective holes of interface platform 104.

In view 101, radiating element 110 is shown isolated from interface platform 104. Radiating element 110 has two generally cylindrical components, radiating probe 111 and connector body 112, which are offset from one another by filleted extension 113. The distance between radiating probe 111 and connector body 112 produced by filleted extension 113 can depend on desired operating characteristics, which can be larger or smaller than shown. The diameter and thickness of the puck structure forming radiating probe 111 may also vary based on desired operating characteristics. The diameter and thickness of connector body 112 can vary based on the particular connections desired for radiating element 110, such as for coupling to a particular size or type of RF stub.

View 102 illustrates a detailed view of radiating element 115, which is shown inserted into a corresponding hole of interface platform 104. Radiating element 115 comprises connector body 120, radiating probe 116 having a generally cylindrical or puck shape offset from a face of connector body 120 by filleted extension 117, and conductor element 118 that can physically and conductively couple with an RF link (such as RF coaxial stub 125). Similar to radiating element 110, the dimensions and distances between each component of radiating element 115 can be altered to tune radiating element 115 and produce different operating characteristics. When assembled into cover plate 103, radiating element 115 can be electrically coupled to RF coaxial stub 125 via conductor element 118. Radiating element 115 and RF coaxial stub 125 are physically coupled at connector body 120, where connector body 120 attaches to an outer conductor or shield portion of RF coaxial stub 125. When connected, conductor element 118 of radiating element 115 can be inserted into a center conductor receptacle of RF coaxial stub 125 and conductively coupled to center conductor 126. Also, isolation features (not shown in FIG. 1), such as air gaps or dielectric materials, are provided in connector body 120 to electrically isolate radiating probe 116 and conductor element 118 from connector body 120 and the outer conductor/shield of RF coaxial stub 125. Different materials, thicknesses, and widths of the isolation features can be employed to alter or suit desired operating characteristics, such as a desired frequency range.

Coupled to an end of RF coaxial stub 125 (opposite from that of radiating element 115), is connector 130. Connector 130 is coupled, physically and conductively, to RF coaxial stub 125, and comprises center conductor 131 and an outer conductor/shield that forms connector body 132. Connector 130 can be capable of mounting or attaching to covers, plates, circuit boards, or the like (not shown) and propagating RF signals from those mounted elements to/from RF coaxial stub 125. Isolation features, such as air gaps or dielectric materials, are provided in connector body 132 to electrically isolate center conductor 131 from connector body 132 and the outer conductor/shield of RF coaxial stub 125.

In various examples of assemblies of elements shown in FIG. 1, RF coaxial stub 125 is one among a large set of several other RF stubs that are removably coupled between connectors mounted on a circuit board and associated radiating elements. Once each RF stub is mounted into a respective circuit board connector, then cover plate 103 may be placed over the RF stubs and circuit board such that the RF stubs are positioned into alignment with corresponding holes of corresponding interface platforms. At this point in assembly, radiating elements are not installed. Then, once the cover plate has been installed over the RF stubs and circuit board, individual radiating elements can be independently coupled to each RF stub aligned with the holes of the interface platforms of the cover plate. When radiating elements, such as radiating elements 110 and 115, are installed into cover plate 103, RF seal 105 can be provided to electrically shield and separate RF signals being carried by each radiating element into an associated waveguide cavity (not shown).

RF coaxial stub 125 can couple on associated longitudinal ends to both connector body 120 and connector body 132. Coupling features, such as threads, bayonet couplers, snap-in, or friction-fit features can be employed on connector body 120 and connector body 132 to couple to RF coaxial stub 125, and the coupling features can vary on different ends of RF coaxial stub 125. The main longitudinal shaft of RF coaxial stub 125 can be rigid and formed from a metallic material that also forms an outer conductor or shield portion. However, other materials and flexibility configurations can be employed, such as conductively coated plastic or composite material, short portions of coaxial cable, or coated ceramic materials.

Figure 2:
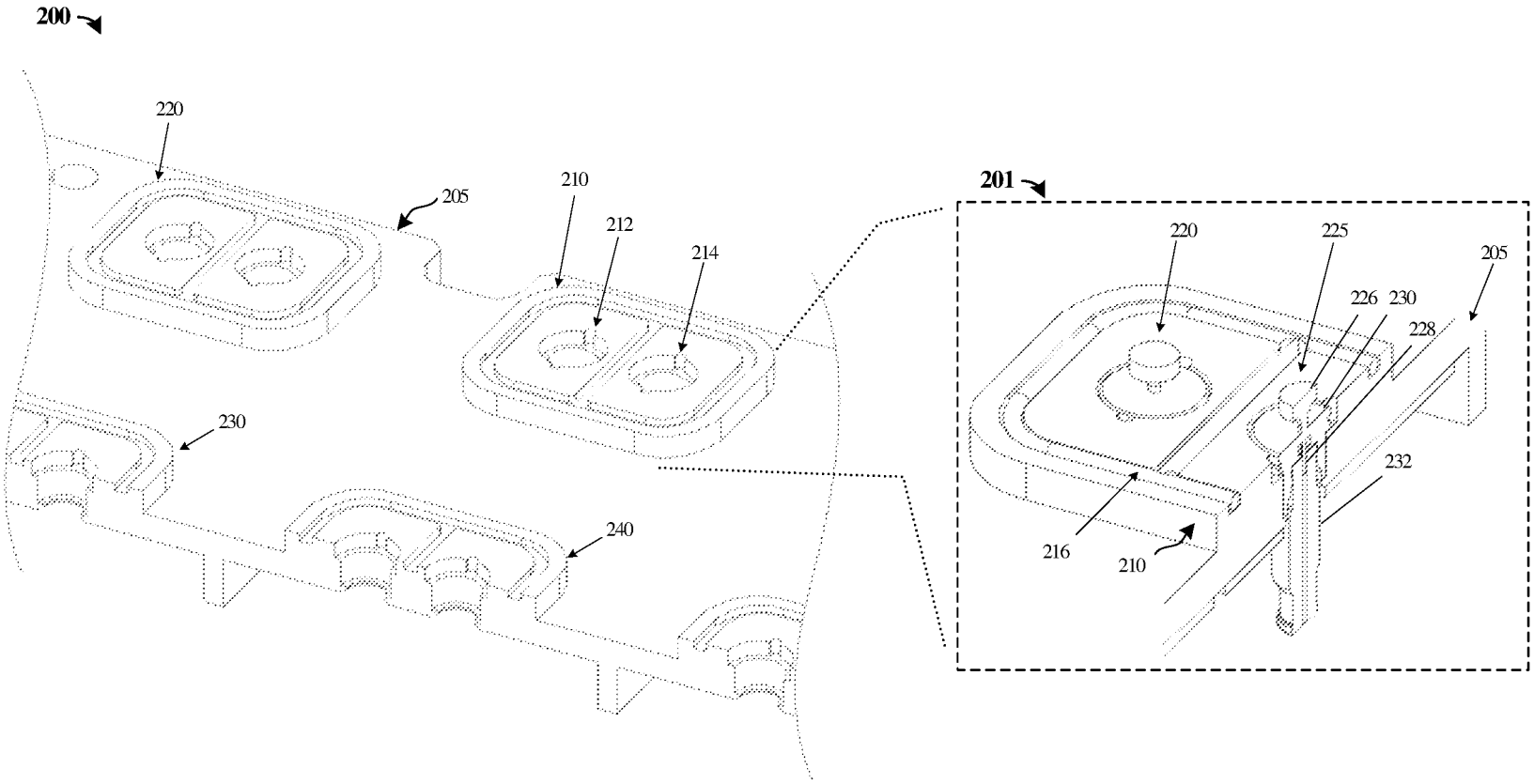
FIG. 2 illustrates example aspects of a cover plate and accompanying radio frequency radiating element used in an implementation.

FIG. 2 includes views 200 and 201 that illustrate features of a cover plate and accompanying RF radiating elements. View 200 illustrates cover plate 205 and interface platforms 210, 220, 230, and 240. Interface platform 210 demonstrates element holes 212 and 214. View 201 illustrates interface platform 210 with two radiating elements, namely radiating elements 220 and 225, inserted into corresponding element holes 212 and 214. View 201 further illustrates components associated with radiating element 225, such as radiating probe 226, conductor element 228, and connector body 230, RF coaxial stub 232, and an RF seal 216.

In view 200, a portion of cover plate 205 having several structures forming interface platforms 210, 220, 230, and 240 is shown. One of these structures, interface platform 210, is included and is elevated or embossed on cover plate 205. Interface platform 210 comprises apertures, or element holes 212 and 214, into which radiating elements can be inserted from above after corresponding RF stubs are aligned from below. Other interface platforms (interface platforms 220, 230, and 240) also comprise element holes to hold additional radiating elements. The element holes, such as element holes 212 and 214, have generally circular openings and may have bevels or edges to hold portions of the radiating elements in place when inserted. To affix each radiating element into an interface platform, the radiating elements can be pressed, twisted, screwed, or otherwise inserted into place into a corresponding cavity of the interface platform.

In view 201, radiating elements 220 and 225 are shown in an inserted position in interface platform 210. In this inserted position, a portion of radiating elements 220 and 225 (radiating probe 226 of radiating element 225) protrudes from interface platform 210 and extends above both interface platform 210 and cover plate 205. Meanwhile, other portions of radiating elements 220 and 225, such as connector body 230, may remain flush or recessed into element holes 212 and 214. In various instances, radiating elements 220 and 225 (and others not depicted in FIG. 2) can be secured into interface platform 210 with an adhesive or epoxy applied or injected into the respective holes of interface platform 210.

View 201 also illustrates several components of radiating element 225, which is shown inserted into a corresponding hole (element hole 214) of interface platform 210. Radiating element 225 comprises connector body 230, radiating probe 226 having a generally cylindrical or puck shape offset from a face of connector body 230 by a filleted extension, and a conductor element 228 that can physically and conductively couple with an RF link, such as RF coaxial stub 232. It may be appreciated that the distance between radiating probe 226 and connector body 230 produced by the filleted extension can depend on desired operating characteristics and can be larger or smaller than shown. The size (e.g., diameter, thickness) of the puck structure forming radiating probe 226 can also vary based on desired operating characteristics. The size of connector body 230 can vary based on particular connections desired for radiating element 225, such as for coupling to a particular size or type of RF stub. For example, RF stub may be a coaxial bullet adapter, coaxial cable, small circuit board, or the like, that uses a different connection mechanism than connector body 230.

When assembled into cover plate 205 and interface platform 210, radiating element 225 can be electrically coupled to RF coaxial stub 232 via conductor element 228. Radiating element 225 and RF coaxial stub 232 are physically coupled at connector body 230, where connector body 230 attaches to an outer conductor/shield portion of RF coaxial stub 232. When connected, conductor element 228 can be inserted into a center conductor portion of RF coaxial stub 232 and conductively coupled to a center conductor of RF coaxial stub 232 (not shown in FIG. 2). Isolation features (not shown in FIG. 2), such as air gaps and dielectric material, can separate radiating probe 226 and conductor element 228 from connector body 230 and the outer conductor of RF coaxial stub 232 to provide electrical isolation. Various materials, thicknesses, and widths of these isolation features can be employed to tune operating characteristics like a desired frequency range.

RF coaxial stub 232 can be coupled with another connector on the end opposite from that of radiating element 225. Like connector body 230, this connector can comprise isolation features, a center conductor, and an outer conductor/shield to allow physical and conductive connection to RF coaxial stub 232. Such a connector is also capable of mounting or attaching to covers, plates, circuit boards, or the like (not shown in FIG. 2) to propagate RF signals from those mounted elements to and from RF coaxial stub 232.

Though only two radiating elements and one RF coaxial stub are illustrated in FIG. 2, various implementations provide for a large arrangement of radiating elements each individually coupled with a RF coaxial stub in corresponding holes of interface platforms. After assembly of each pair of radiating element-RF coaxial stub within respective holes of interface platforms on cover plate 205, RF seal 216 can be applied to electrically shield and separate RF signals being carried out be each radiating element into a corresponding waveguide cavity (not shown). It may be appreciated that the RF signals propagated through radiating elements 220 and 225 (and other radiating elements not shown) can be different, opposite, or complementary signals. RF seal 216 isolates not only the individual polarizations associated with the radiating elements from each other (intra-interface platform) but also from external environments.

Figure 3:
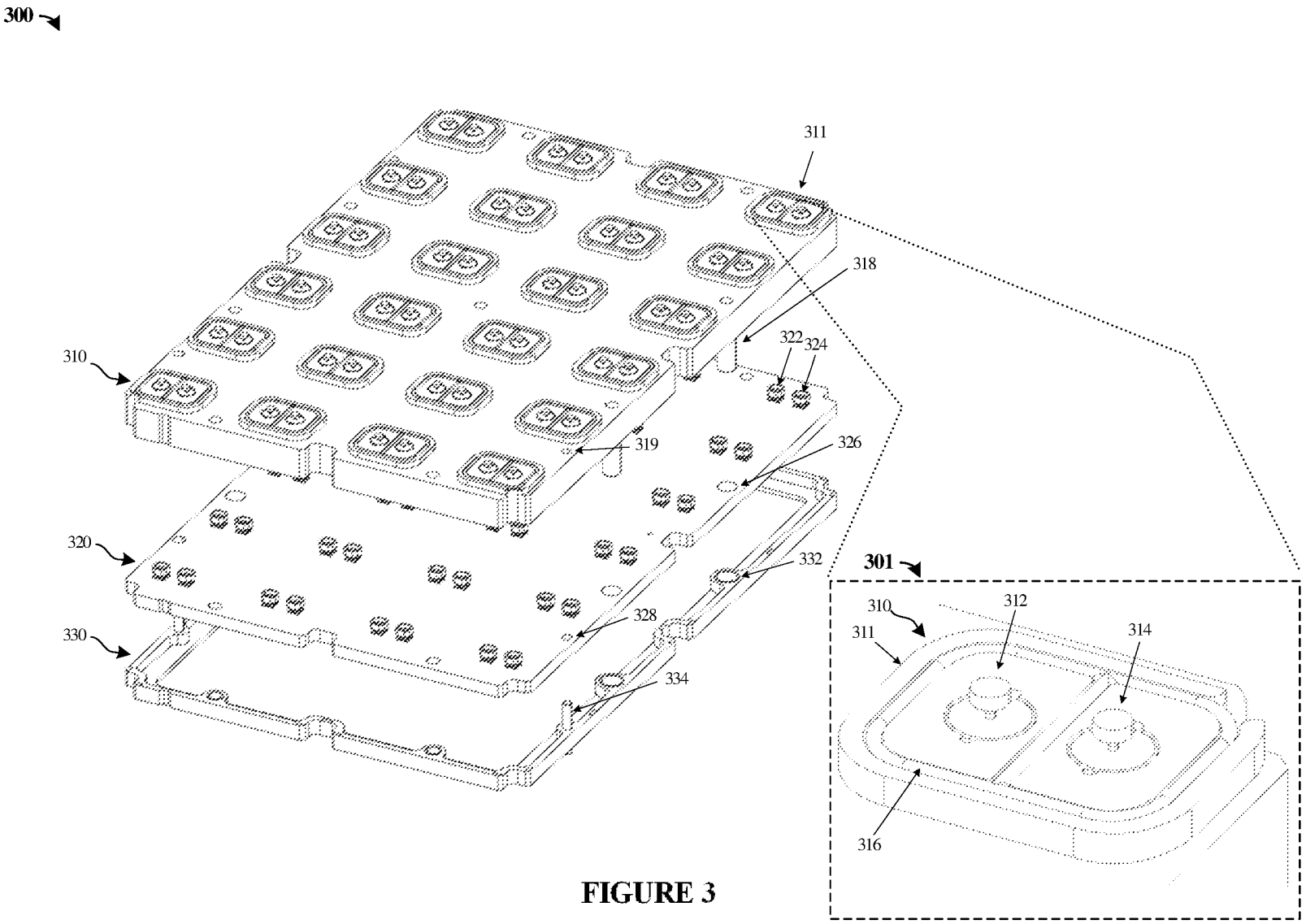
FIG. 3 illustrates example structural aspects of an antenna assembly wherein radio frequency radiating elements can be interfaced with coaxial stubs and placed into cover plate cavities and the cover plate can be coupled with a PCB in an implementation.

One such large arrangement of radiating elements is shown in FIG. 3. FIG. 3 can illustrate example configurations for any of the previously mentioned components in FIGS. 1 and 2. FIG. 3 includes views 300 and 301 that illustrate various features of an enhanced antenna assembly. View 300 includes cover plate 310, circuit board 320, and protective plate 330 and various elements associated with each. View 301 includes a detailed view of interface platform 311 of cover plate 310, which further includes radiating element 312, radiating element 314, and RF seal 316.

In view 300, three plates, boards, or platforms are shown separated from each other. The top-most, cover plate 310, comprises an array of interface structures forming twenty-four (24) interface platforms on the top size of cover plate 310, each holding a pair of radiating elements. Each interface platform, such as interface platform 311, has a similar shape/size and is separated a distance from one another on cover plate 310. The pair of radiating elements that each interface platform includes are also distanced from each other as shown, which allows for RF/electrical isolation of RF signals provided by each pair. Other configurations, spacing, and sizing may be employed depending on desired operating characteristics of the antenna assembly or various packaging/stack-up constraints.

In this example, the use of pairs of radiating elements on each of the 24 interface platforms provides for differently polarized signals to be radiated into corresponding waveguides (not shown) when coupled on top of each interface platform. A first among the radiating elements of each interface platform can be employed for a first polarization (such as left-hand polarized signals) and a second among the radiating elements of each interface platform can be employed for a second polarization (such as right-hand polarized signals). Other polarization, such as vertical, horizontal, circular, and the like, can be separately carried by individual ones among the radiating elements of each interface platform. A waveguide element will be coupled to each of the radiating elements of each interface platform which carries RF signals to an associated polarizer, filter, or ultimately, horn antenna element. The individual polarizations associated with the radiating elements of the interface platforms are isolated from each other (intra-platform) and from the external environment using the RF seals employed on each interface platform.

View 301 shows a detailed view of interface platform 311 located on cover plate 310. Interface platform 311 includes two holes or apertures into which radiating elements 312 and 314 are installed. Radiating elements 312 and 314 can be installed into interface platform 311 by being pressed, twisted, screwed, otherwise inserted into a corresponding hole/cavity of interface platform 311. In an installed position, a portion of radiating elements 312 and 314 can protrude from interface platform 311 and extend above both interface platform 311 and cover plate 310. Meanwhile, other portions of radiating elements 312 and 314 (not shown) may remain flush or recessed into the structure of the corresponding hole of interface platform 311. Each radiating element may be further secured into the corresponding interface platform with an adhesive that can be injected into the hole of interface platform and applied to outer portions of each radiating element. Subsequently, RF seal 316 can be added to interface platform 311 to provide electrical isolation and separation of RF signals being carried by each radiating element. RF seal 316, as well as the other RF seals discussed herein, can comprise a conductive or partially-conductive gasket, such as a metal impregnated rubber, a spring/spiral gasket, conductive putty, conductive adhesive, conductive tape, or other similar features.

Referring back to view 300, circuit board 320 forms another layer in the antenna assembly. Circuit board 320 includes several pairs of connector arrangements, such as connector 322 and connector 324, which can be arranged in the same pattern as the radiating elements of cover plate 310. In fact, each connector arrangement can be placed on circuit board 320 to ensure alignment with a corresponding radiating element of cover plate 310. Each connector arrangement on circuit board 320 has a generally cylindrical shape and is mounted or attached to circuit board 320 in a vertical position via an attachment feature. These connectors can be surface-mount or through-hole type of components and soldered to circuit board 320 to couple to associated transmit/receive circuitry of circuit board 320. In some cases, circuit board 320 is an interface board which only includes various interconnect for the connectors and further couples to another set of circuits or circuit boards which house the transmit/receive circuitry. Each connector arrangement can then be coupled, physically and conductively, to an RF coaxial stub (not shown), and comprises a center conductor and an outer conductor/shield that forms a connector body. When a RF coaxial stub is coupled with a connector arrangement, various isolation features (such as air gaps or dielectric materials), can be provided in the connector body to electrically isolate the center conductor of the connector arrangement from the connector body and an outer conductor/shield of the RF coaxial stub. Furthermore, when coupled together, each connector arrangement can be configured to propagate RF signals from circuit board 320 to a corresponding RF coaxial stub.

Next, view 300 also includes protective plate 330. Protective plate 330 serves as a cover or shield for at least a portion of circuit board 320. Protective plate 330 may be formed out of metal, plastic, fiberglass, or some composite or other material which can have conductive material applied thereto. Structurally, protective plate 330 comprises pegs and holes, such as peg 334 and hole 332, to affix itself to circuit board 320 and cover plate 310. Circuit board 320 also comprises holes, such as hole 328 and hole 326, which are aligned with peg 334 and hole 332 of protective plate 330, respectively. Cover plate 310 comprises holes and pegs, such as hole 319 and peg 318, aligned with hole 328 and hole 326 of circuit board 320 and peg 334 and hole 332 of protective plate 330, respectively. Cover plate 310, circuit board 320, and protective plate 330 can be coupled together when peg 318 is inserted into hole 326 and hole 332 and peg 334 is inserted into hole 328 and 319. Other pegs and holes of each layer can also be coupled together to ensure a secure connection.

Figure 4:
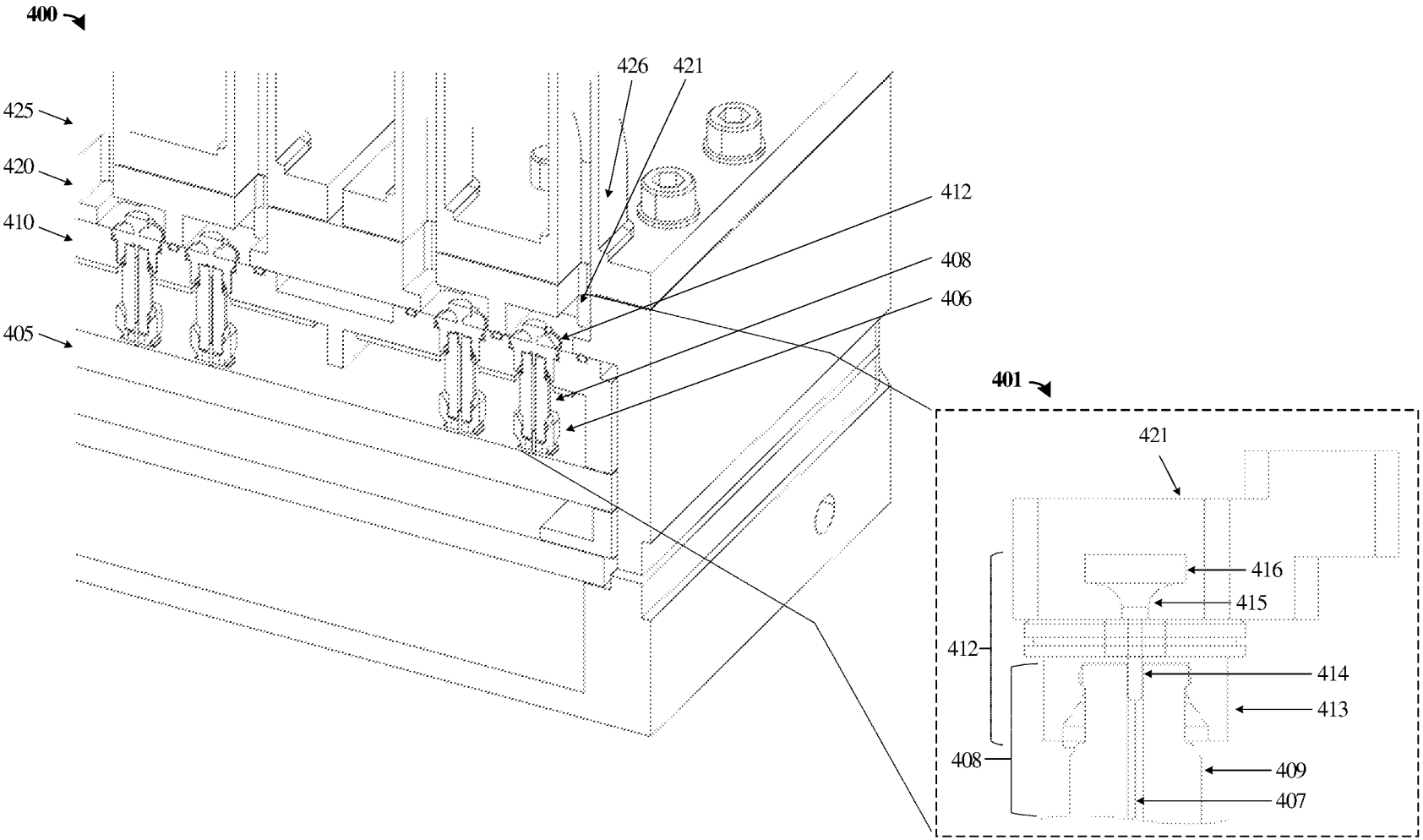
FIG. 4 illustrates example aspects of internal structures of an antenna assembly and corresponding waveguide interfaces used in an implementation.

FIG. 4 includes view 400 and view 401, which illustrate examples of internal structures of an enhanced antenna assembly. View 400 includes an internal cross-section view that shows circuit board 405, cover plate 410, transition plate 420, and horn antenna assembly 425. View 401 depicts a detailed view of an interface between cover plate 410 and transition plate 420, and shows components of radiating element 412 interfaced with waveguide cavity 421 of transition plate 420.

In view 400, a portion of an antenna assembly having several layers of components coupled together and configured to propagate RF signals to an antenna array is shown. In operation, RF signals are obtained from a circuit board 405 and propagated through RF coaxial stubs (e.g., RF coaxial stub 408) coupled with radiating elements of cover plate 410 (e.g., radiating element 412). The RF signals can then be emitted from the radiating elements through waveguide cavities (e.g., waveguide cavity 421) of transition plate 420 to ports of horn antenna assembly 425 (e.g., horn antenna port 426).

Circuit board 405 comprises several connector arrangements, such as connector 406, each capable of carrying RF signals from circuit board 405. Each connector arrangement has a generally cylindrical shape and is mounted or attached to circuit board 405 in a vertical position via an attachment feature. Each connector arrangement can be coupled, physically and conductively, to a RF coaxial stub, such as RF coaxial stub 408, to propagate the RF signals from circuit board 405 to the RF coaxial stub. Each connector arrangement comprises a center conductor and an outer conductor/shield that forms a body of the connector arrangement. Likewise, each RF coaxial stub also comprises a center conductor (e.g., center conductor 407) and an outer conductor/shield (e.g., outer conductor 409). As an example, when RF coaxial stub 408 is coupled with connector 406, the center conductor of connector 406 can be inserted into a receptacle of RF coaxial stub 408 and conductively coupled with center conductor 407 of RF coaxial stub 408. And the outer conductor/shield of connector 406 can be physically coupled with outer conductor 409 of RF coaxial stub 408. When coupled together, isolation features, such as air gaps or dielectric materials, can be provided to electrically isolate the center conductor of connector 406 from at least outer conductor 409 of RF coaxial stub 408.

Next, a portion of cover plate 410 is shown. Cover plate 410 comprises several interface structures (as seen herein) with holes into which radiating elements can be installed. In view 400, four radiating elements are inserted into holes of cover plate 410. To affix each radiating element to cover plate 410, the radiating elements can be pressed, twisted, screwed, or otherwise inserted into place into a corresponding hole. In an inserted position, a portion of the radiating elements can protrude from the interface platforms and cover plate 410, while other portions of the radiating elements can remain flush or recessed into corresponding holes of cover plate 401.

During assembly, cover plate 410 may be placed over the RF coaxial stubs that are coupled between connector arrangements mounted on circuit board 405 such that the RF coaxial stubs are positioned into corresponding holes of corresponding interface platforms on cover plate 410. Following this step, each radiating element can be individually coupled to each RF coaxial stub within the holes of the interface platforms of cover plate 410. Then, transition plate 420 can be affixed to cover plate 410 in an alignment where individual waveguide cavities of transition plate 420 are coupled over individual radiating elements installed in cover plate 410. Each waveguide cavity can be positioned and coupled at portions of the interface platforms of cover plate 410 where RF sealing is applied. This establishes electrical isolation between each waveguide cavity-radiating element coupling. In various implementations, the waveguide cavities each comprise a tuned transition cavity having a bend that axially offsets an individually-coupled radiating element from corresponding ports of horn antennas. View 401 provides an illustration of such an interface between radiating element 412 of cover plate 410 and waveguide cavity 421 of transition plate 420.

In view 401, a component of radiating element 412, namely radiating probe 416, is shown protruding into a portion of waveguide cavity 421. Radiating element 412 comprises connector body 413, radiating probe 416 having a generally cylindrical or puck shape offset from a face of connector body 413 by filleted extension 415, and conductor element 414 that can physically and conductively couple with an RF link (such as RF coaxial stub 408). When cover plate 410 and transition plate 420 are coupled, radiating probe 416 extends a distance into waveguide cavity 421. In this example, waveguide cavity 421 comprises a 90-degree bend that can guide and tune the RF signals propagated from radiating probe 416 to waveguide cavity 421 before reaching a filter or polarizer associated with a horn antenna. Both the bend and dimensions of waveguide cavity 421 can be altered depending on desired operating characteristics. Likewise, the amount of protrusion (i.e., length) of radiating probe 416 into waveguide cavity 421 and other characteristics of radiating probe 416, like the distance between radiating probe 416 and connector body 413, can depend on the size of filleted extension 415, and consequently, desired operating characteristics. The diameter and thickness of the puck structure forming radiating probe 416 may also vary based on desired operating characteristics. The diameter and thickness of connector body 413 can vary based on a particular type of connection desired for radiating element 412, such as for coupling to a specific size or type of RF stub. When coupled with RF coaxial bullet 408, radiating element 412 and RF coaxial stub are physically coupled at connector body 413, where connector body 413 attaches to an outer conductor 409 of RF coaxial stub 408. Conductor element 414 of radiating element 412 can be inserted into a center conductor receptable of RF coaxial rub 408 and conductive coupled to center conductor 407 of RF coaxial stub 408. Isolation features (not shown), such as air gaps or dielectric materials, can be present to provide electrical isolation between radiating probe 416 and conductor element 414 from connector body 413 and outer conductor 409. Varied materials, thicknesses, and widths of the isolation features can be employed to alter or suit desired operating characteristics, such as a desired frequency range.

Referring back to view 400, each waveguide cavity of transition plate 420 can be individually coupled with a port of horn antenna assembly 425. In this example view, waveguide cavity 421 is coupled with horn antenna port 426. Horn antenna assembly 425 may comprise one port for each waveguide cavity-radiating element interface allowing each port to propagate isolated RF signals to one or more horn antennas. By way of example, a pair of radiating elements can carry differently polarized signals into corresponding waveguide cavities when transition plate 420 is coupled on top of each interface platform of cover plate 410. A first among the radiating elements of each interface platform can be employed for a first polarization (such as left-hand polarized signals) and a second among the radiating elements of each interface platform can be employed for a second polarization (such as right-hand polarized signals). The individual polarizations associated with the radiating elements of the interface platforms are isolated from each other (intra-platform) and from the external environment using RF seals employed on each interface platform. As such, filters or polarizers within the ports of horn antenna assembly 425 can receive the individual polarizations and can be capable of tuning the RF signals further. The size and shape of each port and filter of horn antenna assembly 425 can be configured to produce desired output characteristics, such as desired frequency ranges, gain properties, or loss characteristics, among other characteristics.

Figure 5:
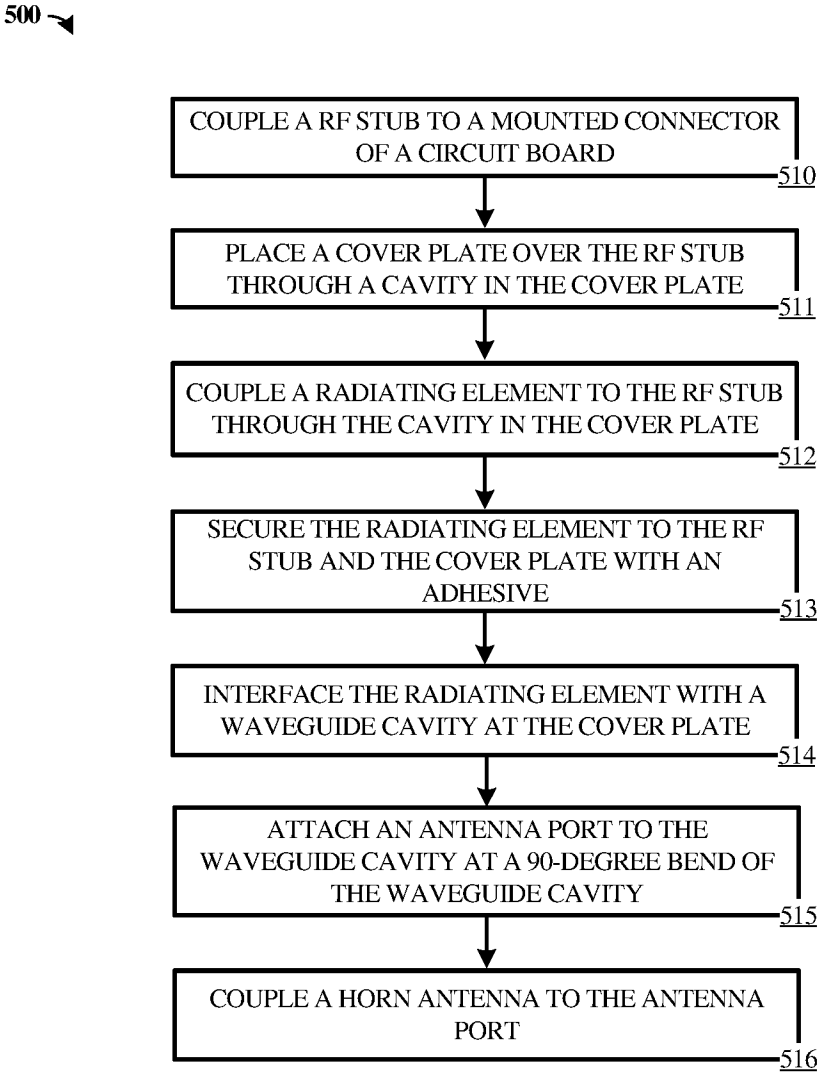
FIG. 5 illustrates an example method of assembling a radio frequency radiating system used in an implementation.

FIG. 5 illustrates an example method of manufacturing an RF radiating system, such as the antenna assembly of FIG. 4 and its various components. FIG. 5 includes operations 500 noted parenthetically in the discussion below and which references elements of FIG. 4.

In operation 510, RF coaxial stub 408 is coupled (510) to a mounted connector or connector arrangement of circuit board 405. RF coaxial stub 408 can be both physically and conductively attached or mated to the connector arrangement. RF coaxial stub 408 comprises center conductor 407 and outer conductor 409 that couple to a center conductor and outer conductor/shield of the connector arrangement, respectively. The mounted connector arrangement may also be configured to carry RF signals from circuit board 405 to RF coaxial stub 408 via the connection between the center conductors.

In operation 511, once RF coaxial stub 408 is coupled to the mounted connector of circuit board 405, cover plate 410 is placed (511) over RF coaxial stub 408 through a cavity in cover plate 410. Cover plate 410 can comprise several interface platforms, wherein each interface platform has holes for RF coaxial stubs.

In operation 512, radiating element 412 is coupled (512) to RF coaxial stub 408 through the cavity (of the interface element) in cover plate 410. Radiating element 412 can comprise connector body 413, radiating probe 416 having a generally cylindrical or puck shape offset from a face of connector body 413 by filleted extension 415, and conductor element 414 that can physically and conductively couple with RF coaxial stub 408. When assembled into cover plate 410, radiating element 412 can be electrically coupled to RF coaxial stub 408 via conductor element 414. Radiating element 412 and RF coaxial stub 408 are physically coupled at connector body 413, where connector body 413 attaches to the outer conductor of RF coaxial stub 408. When connected, conductor element 414 of radiating element 412 can be inserted into a center conductor receptacle of RF coaxial stub 408 and conductively coupled to the center conductor of RF coaxial stub 408.

In operation 513, radiating element 412 is secured (513) to RF coaxial stub 408 and cover plate 410 with an adhesive. The adhesive, such as an epoxy, can be injected into gaps in the cavity of cover plate 410 and/or it can be applied to exposed portions of radiating element 412. Further, a RF seal can be applied to a portion of the interface platform of cover plate 410 to surround radiating element 412 and provide electrical shielding and separate RF signals being carried by radiating element 412.

In operation 514, radiating element 412 is interfaced (514) with waveguide cavity 421 of transition plate 420 at cover plate 410. Waveguide cavity 421 can be positioned and coupled at the interface platform of cover plate 410 where the RF seal is applied to ensure electrical isolation of the RF signals when propagated into waveguide cavity 421. Waveguide cavity 421 comprises a tuned transition cavity having a bend that axially offsets the interfaced radiating element from another portion of the waveguide cavity.

In operation 515, horn antenna port 426 of horn antenna assembly 425 is attached (515) to waveguide cavity 421 at the bend of waveguide cavity 421. In some instances, waveguide cavity 421 is shaped with a 90-degree bend. In other instances, different bends or shapes of the cavity in waveguide cavity 421, such as ones including an angle (other than 90-degrees), curve, taper, or the like, can be employed to reach desired operating characteristics. Further the size/dimensions of the cavity can be varied to affect operating characteristics. Horn antenna port 426 can couple at a bent/shaped portion of waveguide cavity 421 and comprise a filter or polarizer configured to receive the RF signals emitted from radiating element 412 and transmit them to another component of horn antenna assembly 425. In various instances, additional horn antenna ports can be coupled with additional waveguide cavities and radiating elements to receive differently polarized RF signals. For example, the other RF signals propagated through the additional horn antenna ports may be complementary, different, and/or opposite polarizations of the RF signals carried by horn antenna port 426.

In operation 516, a horn antenna is coupled (516) to horn antenna port 426. Following this final step of assembly, the RF signals can travel from circuit board 405 through RF coaxial stub 408 to radiating element 412 through waveguide cavity 421 horn antenna port 426 and to the horn antenna to be transmitted.

It may be appreciated that other methods or orders of assembling such an antenna assembly can be accomplished using similar components, different components, or any combination thereof. For example, the components of the antenna assembly can be manufactured by subtractive machining techniques, 3D printing or additive manufacturing techniques, injection molding techniques, or casted, including combinations thereof. Each component can be 3D printed as singular workpieces or it can be machined/cast from separate workpieces. With respect to assembly, in one instance, the cover plate may be installed over radiating elements and RF coaxial stubs after the radiating elements and RF coaxial stubs have been coupled. In other instances, the horn antennas/ports and filters may be installed and coupled with the transition plate and waveguide interfaces together. Various combinations of assembly are contemplated and need not be discussed thoroughly for the sake of brevity. It may also be appreciated that the discussion of FIG. 5 included only the assembly of a single RF coaxial stub and radiating element. However, schemes with sets of each, wherein each are individually interfaced with waveguide cavities, filters, and horn antennas, among other components, are contemplated by this disclosure.

Figure 6:
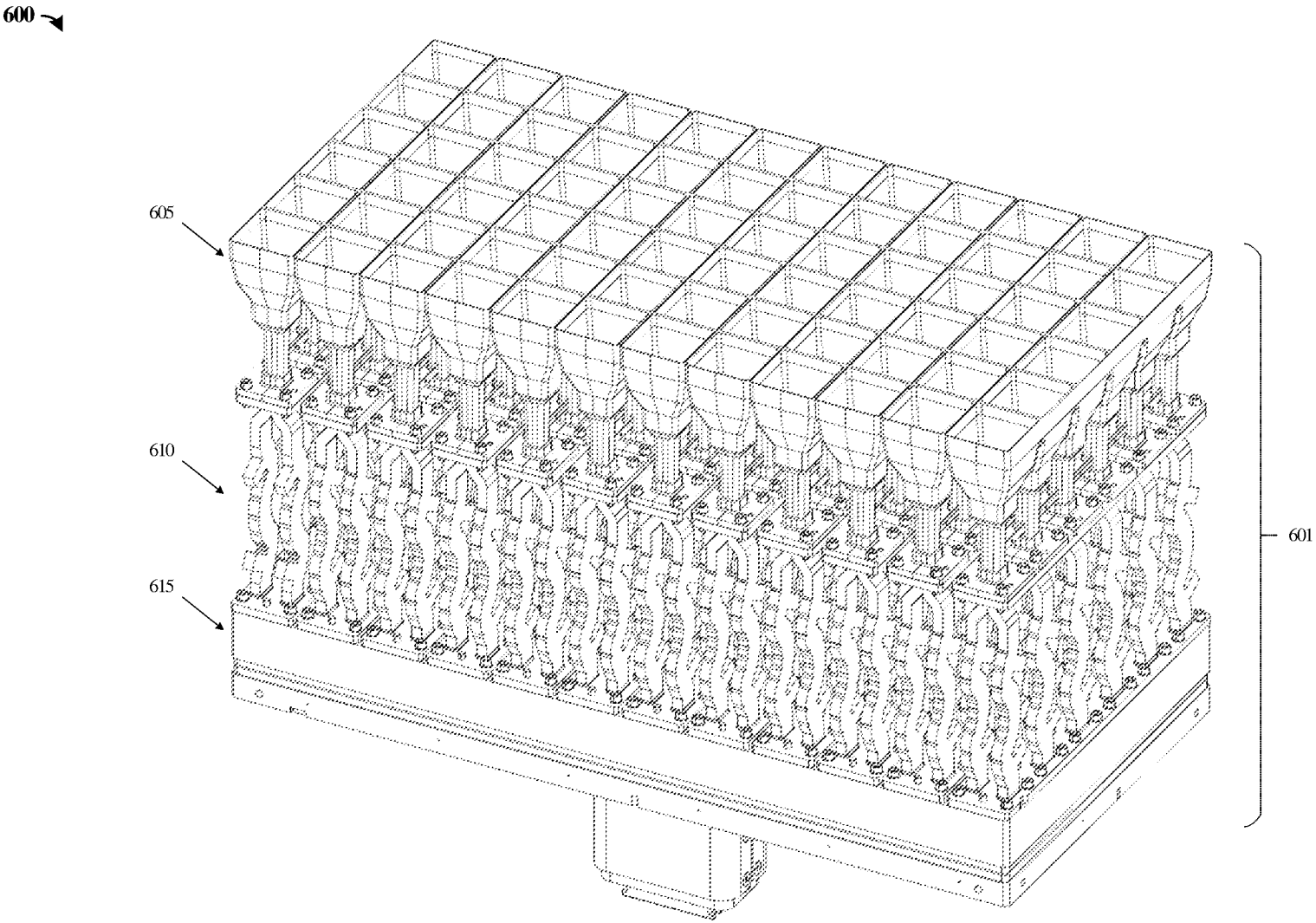
FIG. 6 illustrates an example aspect of an antenna assembly in an implementation.

FIG. 6 includes view 600, which further includes antenna assembly 601 comprising horn antenna array 605, filters 610, and RF interface system 615. Antenna assembly 601 can be an example of any of the antenna assemblies discussed herein, which may incorporate the various components discussed in the preceding Figures.

In operation, RF signals are generated or obtained by RF interface system 615, propagated through filters 610, and emitted by horn antenna array 605. More specifically, RF interface system 615 can comprise a plurality of RF links coupled between circuit board(s) and radiating elements, like ones discussed herein. RF interface system 615 can further include various plates or boards to house transmitter/receiver circuitry, power amplifier circuitry, or other RF circuitry. The plates can allow for both physical and electrical coupling of such equipment, and it can provide mounting points where radiating elements can be mated to RF links or stubs on the circuit board(s) and where transition plates or waveguides can be interfaced with the radiating elements. In some cases, the circuit board(s) included in RF interface system 615 may serve as an interconnect to distribute and align RF links to an array of filters 610 and horn antennas. RF interface system 615 can also include a protective case or elements to shield such internal components from external environments.

Filters 610 can be coupled and/or mounted to RF interface system 615 at a top side of RF interface system 615. Filters 610 can comprise multiple ports and filters/polarizers configured to carry the RF signals generated and propagated throughout RF interface system 615. For example, each port and filter of filters 610 can be aligned with individual ones of the waveguides, radiating elements, and RF stubs of RF interface system 615 to carry a corresponding, individually polarized RF signal. Accordingly, each port and filter may carry different or complementary RF signals and pass them to horn antenna array 605 for emission.

Horn antenna array 605 can be mechanically mounted, coupled, or otherwise attached to filters 610. In an instance, one horn antenna of horn antenna array 605 can be coupled with one port/filter of filters 610. In other instances, however, one antenna can be coupled with multiple filters and vice versa, or any combination thereof. The horn antennas of horn antenna array 605 can have various types or shapes of apertures, such as one or any among square, round, triangular, hexagonal, irregular, or the like. Regardless of shape, horn antenna array 605 can emit RF signals (or receive) with frequency response characteristics that vary based on the components of RF transmission interface 615 and filters 610 and the shapes, dimensions, and types of such components.

Figure 7:
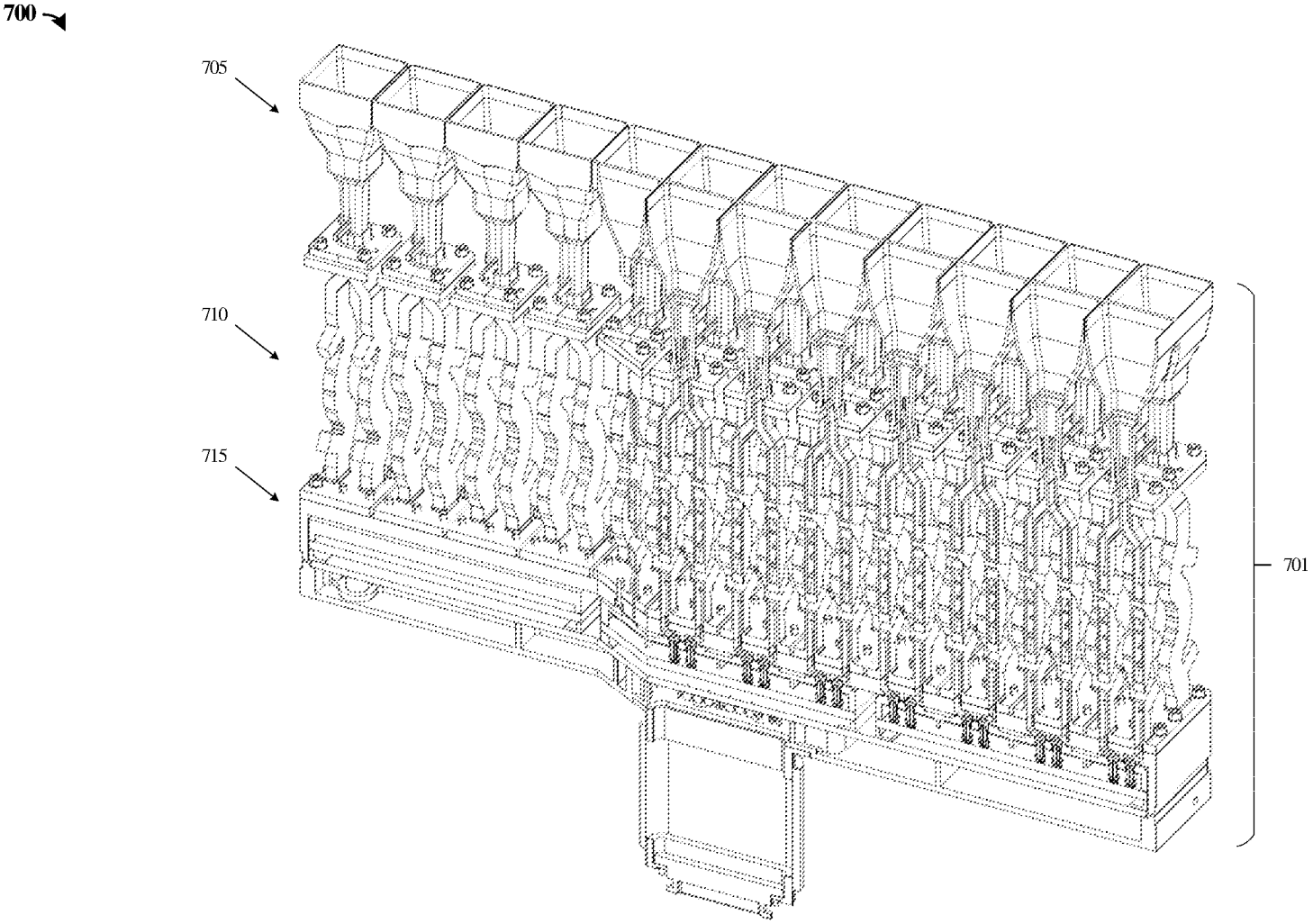
FIG. 7 illustrates an example internal aspect of an antenna assembly in an implementation.

FIG. 7 illustrates view 700 demonstrating a partial internal cross-sectional aspect of antenna assembly 701, which further includes horn antenna array 705, filters 710, and RF transmission interface 715. Antenna assembly 701 can be an example of any of the antenna assemblies discussed herein, which may incorporate the various components discussed in the preceding Figures.

In operation, RF signals are generated or obtained by RF interface system 715, propagated through filters 710, and emitted by horn antenna array 705. More specifically, RF interface system 715 can comprise a plurality of RF links coupled between circuit board(s) and radiating elements, like the ones discussed herein. RF interface system 715 can further include various plates or boards to house transmitter/receiver circuitry, power amplifier circuitry, or other RF circuitry. The plates can allow for both physical and electrical coupling of such equipment, and it can provide mounting points where radiating elements can be mated to RF links or stubs on the circuit board(s) and where transition plates or waveguides can be interfaced with the radiating elements. In some cases, the circuit board(s) included in RF interface system 715 may serve as an interconnect to distribute and align RF links to an array of filters 710 and horn antennas. RF interface system 715 can also include a protective case or elements to shield such internal components from external environments.

Filters 710 can be coupled and/or mounted to RF interface system 715 at a top side of RF interface system 715. Filters 710 can comprise multiple ports and filters/polarizers configured to carry the RF signals generated and propagated throughout RF interface system 715. For example, each port and filter of filters 710 can be aligned with individual ones of the waveguides, radiating elements, and RF stubs of RF interface system 715 to carry a corresponding, individually polarized RF signal. Accordingly, each port and filter may carry different or complementary RF signals and pass them to horn antenna array 705 for emission.

Horn antenna array 705 can be mechanically mounted, coupled, or otherwise attached to filters 710. In an instance, one horn antenna of horn antenna array 705 can be coupled with one port/filter of filters 710. In other instances, however, one antenna can be coupled with multiple filters and vice versa, or any combination thereof. The horn antennas of horn antenna array 705 can have various types or shapes of apertures, such as one or any among a square, round, irregular, triangular, hexagonal, or the like. Regardless of shape, horn antenna array 705 can emit RF signals at varied frequencies based on the components of RF transmission interface 715 and filters 710 and the shapes, dimensions, and types of such components.

The functional block diagrams, operational scenarios and sequences, and flow diagrams provided in the Figures are representative of exemplary systems, environments, and methodologies for performing novel aspects of the disclosure. While, for purposes of simplicity of explanation, methods included herein may be in the form of a functional diagram, operational scenario or sequence, or flow diagram, and may be described as a series of acts, it is to be understood and appreciated that the methods are not limited by the order of acts, as some acts may, in accordance therewith, occur in a different order and/or concurrently with other acts from that shown and described herein. For example, those skilled in the art will understand and appreciate that a method could alternatively be represented as a series of interrelated states or events, such as in a state diagram. Moreover, not all acts illustrated in a methodology may be required for a novel implementation.

The various materials and manufacturing processes discussed herein are employed according to the descriptions above. However, it should be understood that the disclosures and enhancements herein are not limited to these materials and manufacturing processes and can be applicable across a range of suitable materials and manufacturing processes. Thus, the descriptions and figures included herein depict specific implementations to teach those skilled in the art how to make and use the best options. For the purpose of teaching inventive principles, some conventional aspects have been simplified or omitted. Those skilled in the art will appreciate variations from these implementations that fall within the scope of this disclosure. Those skilled in the art will also appreciate that the features described above can be combined in various ways to form multiple implementations.

What is claimed is:

1. An antenna assembly, comprising:

a cover plate for a circuit board coupled to radio frequency (RF) coaxial stubs, the cover plate having a top side and a bottom side and comprising holes into which the RF coaxial stubs fit from the bottom side and radiating elements couple onto to the RF coaxial stubs from the top side;

a transition plate comprising waveguide cavities that transition between individual ones of the radiating elements on the top side of the cover plate and corresponding ports of horn antennas;

wherein the radiating elements each comprise:

a radiating probe having a generally cylindrical shape offset from a base by a filleted extension;

a connector body configured to attach to an outer conductor portion of a corresponding coaxial RF stub and form the base on an end opposite from the corresponding coaxial RF stub; and a conductor element configured to conductively couple a center conductor of the corresponding coaxial RF stub to the radiating probe and electrically isolate the radiating probe from at least the base.

2. The antenna assembly of claim 1, comprising:

the cover plate comprising interface platforms on the top side, each of the interface platforms having RF sealing features that seal at least one of the radiating elements into a corresponding waveguide cavity when mated to the transition plate.

3. The antenna assembly of claim 2, comprising:

the RF sealing features of each of the interface platforms comprise an electromagnetic interference (EMI) gasket which seals a gap between the interface platforms and corresponding features on the transition plate.

4. The antenna assembly of claim 2, wherein each of the interface platforms encompass holes for two of the radiating elements which form a signal polarization pair and are coupled into separate waveguide cavities of a corresponding polarizer or filter of a horn antenna.

5. The antenna assembly of claim 1, wherein the radiating elements each comprise a dielectric material axially distributed about the conductor element that electrically isolates the conductor element and the radiating probe from the connector body.

6. The antenna assembly of claim 1, wherein the radiating elements each comprise attachment features that couple and hold the conductor element to the corresponding coaxial RF stub.

7. The antenna assembly of claim 1, wherein the circuit board is removably coupled to the RF coaxial stubs with individual RF coaxial connectors.

8. The antenna assembly of claim 1, wherein the waveguide cavities each comprise a tuned transition cavity having a bend that axially offsets the individual ones of the radiating elements from the corresponding ports of horn antennas.

9. An apparatus, comprising:

a radio frequency (RF) radiating element comprising:

a radiating probe having a generally cylindrical shape offset from a base by a filleted extension;

a connector body configured to attach to an outer conductor portion of a corresponding coaxial RF link and form the base on an end opposite from the corresponding coaxial RF link;

a conductor element configured to conductively couple a center conductor of the corresponding coaxial RF link to the radiating probe and electrically isolate the radiating probe from at least the base.

10. The apparatus of claim 9, wherein the RF radiating element comprises a dielectric material axially distributed about the conductor element that electrically isolates the conductor element and the radiating probe from the connector body.

11. The apparatus of claim 9, wherein the RF radiating element comprises attachment features that couple and hold the conductor element to the corresponding coaxial RF link.

12. The apparatus of claim 9, wherein the attachment features are positioned along an inner portion of the conductor body and comprise at least one among threads and press-fit features.

13. The apparatus of claim 9, wherein the RF radiating element further comprises a dielectric material axially distributed about the conductor element, a thickness of the dielectric material selected based at least on a desired operating characteristic of the RF radiating element.

14. The apparatus of claim 9, wherein a length of the filleted extension that separates the base and the radiating probe and a width of the base of the radiating probe is determined by at least a desired operating characteristic of the RF radiating element.

15. A method of assembling a radio frequency (RF) radiating system, comprising:

physically coupling a coaxial bullet to a connector arrangement of a circuit board and conductively coupling a coaxial RF link of the coaxial bullet to a conductor of the circuit board;

physically coupling a feed end of a radiating element offset from a radiating end of the radiating element by a filleted extension to the coaxial RF link of the coaxial bullet and conductively coupling the feed end to an outer conductor portion of the coaxial RF link;

placing a mounting plate over the radiating element and the coaxial bullet through a cavity in the mounting plate;

securing a portion of the radiating element to the coaxial bullet and the mounting plate with an adhesive; and interfacing the radiating end of the radiating element with a waveguide cavity at the mounting plate.

16. The method of claim 15, further comprising conductively coupling a center conductor of the coaxial RF link to the radiating element.

17. The method of claim 16, wherein the feed end of the radiating element and the center conductor of the coaxial RF link are separated by a dielectric and an air gap.

18. The method of claim 15, wherein the waveguide cavity is coupled with the mounting plate at an electromagnetic interference (EMI) gasket of the mounting plate, which seals a gap between the mounting plate and the waveguide cavity.

19. The method of claim 15, wherein physically coupling the feed end of the radiating element to the coaxial RF link of the coaxial bullet comprises connecting the coaxial bullet to a connector arrangement of the radiating element.

20. The method of claim 15, further comprising coupling the waveguide cavity to a port of a horn antenna assembly.

* * * * *